US006655732B1

(12) United States Patent
LaPointe

(10) Patent No.: US 6,655,732 B1
(45) Date of Patent: Dec. 2, 2003

(54) MULTIPLE POSITION LEG REST MECHANISM FOR A RECLINING CHAIR

(75) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 10/197,302

(22) Filed: Jul. 16, 2002

(51) Int. Cl.[7] ..... A47C 1/02
(52) U.S. Cl. ..... 297/85
(58) Field of Search ..... 297/68, 69, 70, 297/83, 84, 85, 87, 89, 423.19, 423.26, 423.28

(56) References Cited

U.S. PATENT DOCUMENTS 3,325,210 A 6/1967 Knabusch et al.
4,367,895 A 1/1983 Pacitti et al.
5,147,108 A * 9/1992 LaPointe ..... 297/84
5,427,431 A * 6/1995 Saul et al. ..... 297/85
5,527,095 A * 6/1996 Marshall et al. ..... 297/83
5,570,927 A 11/1996 LaPointe et al.

* cited by examiner

*Primary Examiner*—Peter R. Brown
(74) *Attorney, Agent, or Firm*—Harness, Dickey & Pierce, P.L.C.

(57) ABSTRACT

A three-position leg rest mechanism is disclosed. The mechanism includes a locking link and sector members rotatably supported on the locking link. The sector members are operably coupled to the drive rod for rotation therewith. A locking pin engages the sector members to selectively lock the drive member, and hence the leg rest assembly in one of three positions. The end of the locking link opposite the sector members is coupled to the support shaft of the actuation mechanism.

18 Claims, 8 Drawing Sheets

MULTIPLE POSITION LEG REST MECHANISM FOR A RECLINING CHAIR

BACKGROUND OF THE INVENTION

The present invention relates generally to reclining chairs and, more particularly, to a three-position leg rest mechanism for a reclining chair.

Traditionally, reclining chairs are equipped with an actuation mechanism which is operatively interconnected between a prefabricated chair frame and a stationary base assembly. The actuation mechanism is typically a combination of various mechanical linkages operable for providing various comfort features such as independent reclining movement of a seat assembly as well as actuation of an extensible leg rest assembly and associated tilting of the chair frame.

While many conventional reclining chairs operate satisfactorily, furniture manufacturers are continually striving to develop improved frames and actuation mechanisms for reducing system complexity and smoothness of operation as well as occupant comfort. Furthermore, there is a continuing desire to develop improved fabrication and assembly techniques which will result in reduced costs while promoting increased efficiency and improved product quality.

SUMMARY OF THE INVENTION

In accordance with the principles of the present invention, an improved leg rest mechanism is disclosed which is more simple and less costly to manufacture, which is more durable and which is easier to maintain than conventional leg rest mechanisms. The improved leg rest mechanism is readily adaptable for use with conventional actuation mechanism In accordance with a preferred embodiment, a reclining chair is provided to include an improved multiple position leg rest mechanism which can be positioned in a retracted position, a first intermediate or partially extended position, a second intermediate position and a fully extended position.

Additional objects, advantages, and features of the present invention will become apparent from the following description taken in conjunction with the accompanying drawings.

DETAILED DESCRIPTION OF THE INVENTION

In accordance with the teachings of the present invention, an improved actuation mechanism for use in single and multi-person articles of furniture (i.e. chairs and sofas or loveseats) is disclosed. A general understanding of the art to which the present invention pertains is disclosed in U.S. Pat. No. 3,325,210, Adjustable Leg Rest Locking Device, and U.S. Pat. No. 5,570,927, Modular Wall Proximity Reclining Chair, which are commonly owned by the assignee of the present invention and the disclosure of which is expressly incorporated by reference herein. As will be described, the pre-assembled actuation mechanism is uniquely suspended in a "fixed" three-pivot-point arrangement from pre-upholstered box-like frame components so as to provide precise mechanical alignment and superior structural rigidity while concomitantly facilitating application of highly efficient fabrication and assembly processes.

Figure 1:
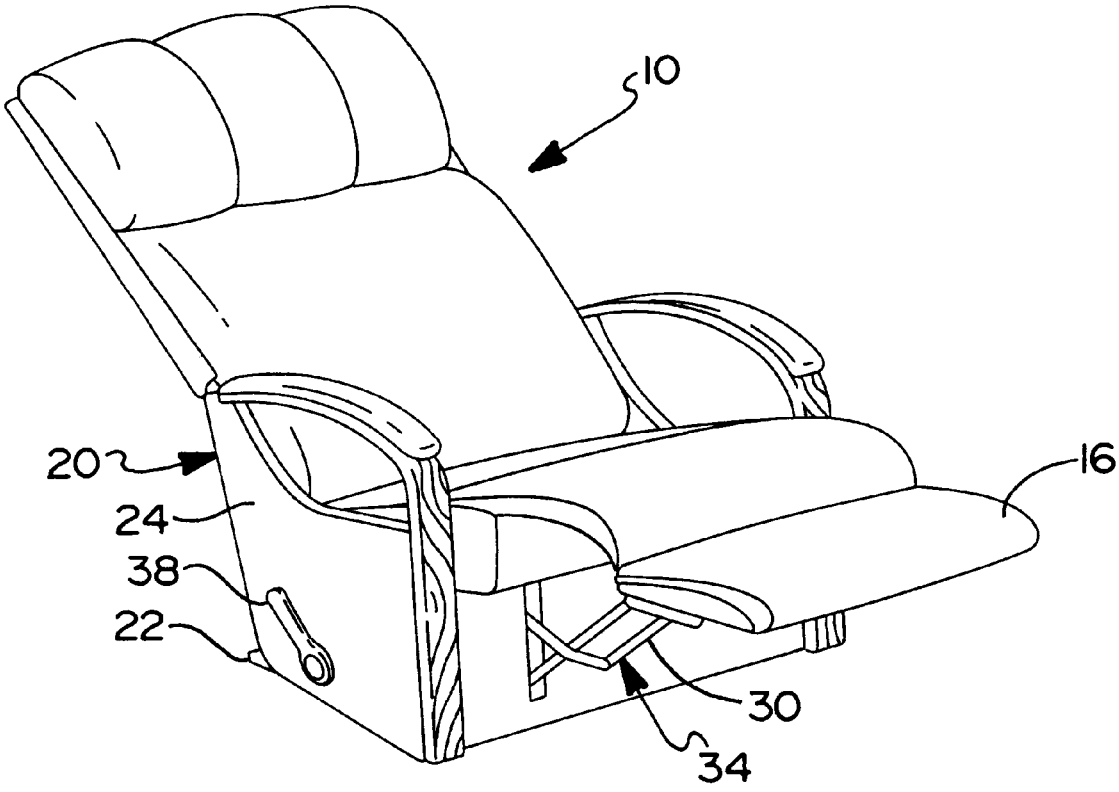
FIG. 1 is an exploded perspective view of a wall proximity reclining/tilt chair in accordance with the present invention.

With reference to FIG. 1, the article of furniture shown is a combination wall proximity recliner and tilt chair, hereinafter referred to wall proximity reclining/tilt chair 10, which includes a pre-assembled actuation mechanism 12 and various upholstered frame components that can be quickly and simply assembled as a modular seating unit. Such "modular" construction provides a significant advancement over conventional furniture fabrication and assembly techniques since manipulation of heavy and cumbersome "unitized" chair frames during upholstery installation is no longer required. As such, each frame component or frame sub-assembly can be upholstered prior to modular assembly with actuation mechanism 12 so as to improve individual component quality as well as overall system quality and production efficiency. Moreover, since actuation mechanism 12 of the present invention is relatively compact in size, the use of loose upholstered cushions, which is an important feature in marketing various styles of chair, sofa or loveseat furniture, is also possible. It should also be understood, however, that the improvements now incorporated into actuation mechanism 12 are not limited to use with reclining/tilting chair 10, but rather are applicable for use in virtually any type of single or multi-person article of furniture. As such, the particular structure of the various sub-assemblies and components which, when assembled, define reclining/tilting chair 10 is merely intended to illustrate but one furniture application to which the present invention is applicable.

Figure 2:
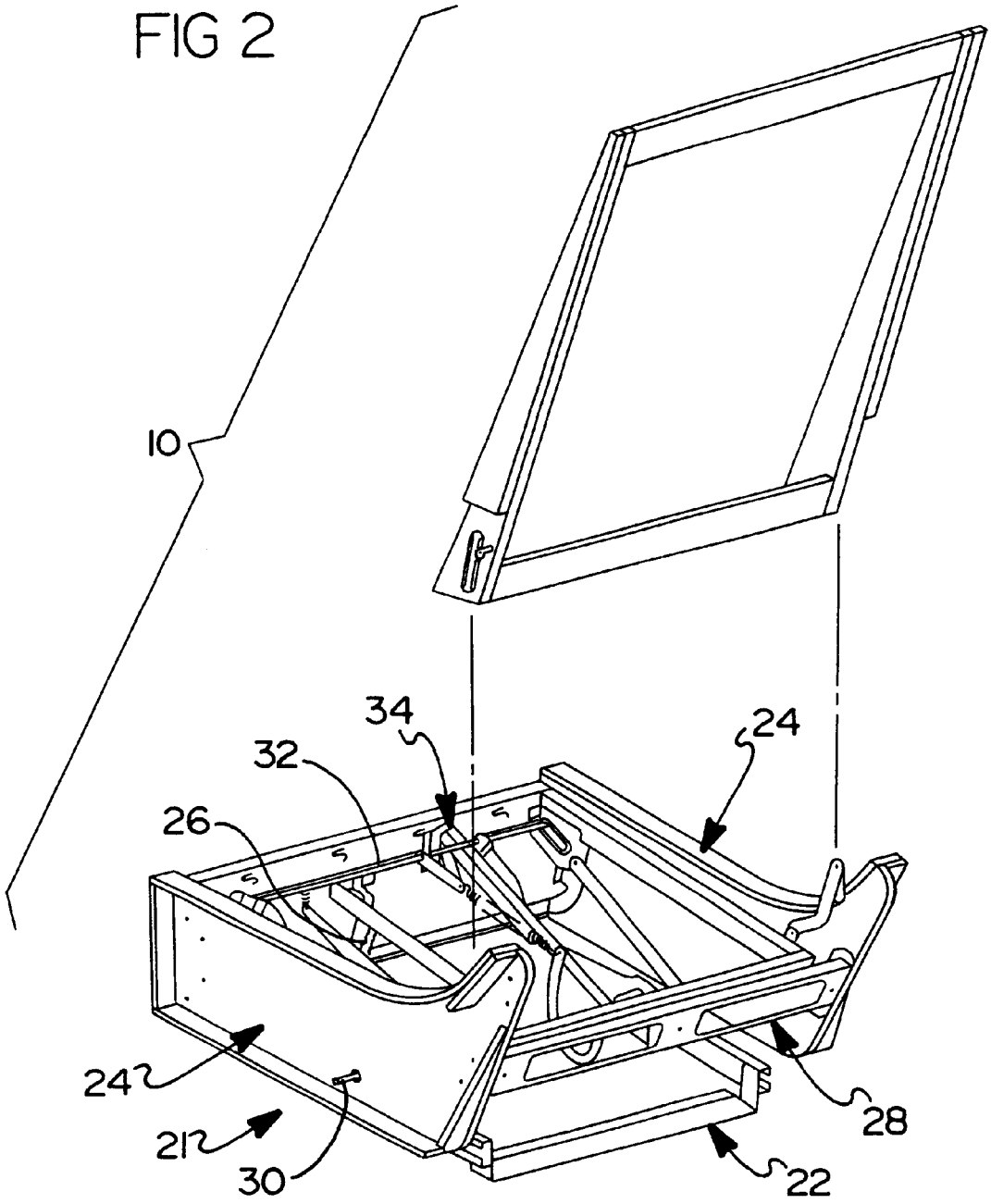
FIG. 2 is a perspective view of the internal frame of the wall proximity reclining/tilt chair shown in FIG. 1.

In accordance with the primary design features of the present invention, the various pre-assembled and upholstered frame components provided for operably suspending actuation mechanism 12 within reclining/tilt chair 10 will now be described. FIG. 2 shows the various pre-assembled frame components with their upholstery, padding, springs, etc. removed to better illustrate the interdependency of the frame components construction which can be rapidly and rigidly assembled in a relative easy and efficient manner. As such, all of the frame components can be individually fabricated or sub-assembled to include the requisite brackets, springs, padding and upholstery on an "off-line" batch-type basis. Thereafter, the various pre-assembled and upholstered frame components are assembled for totally integrating actuation mechanism 12 therein. As noted, while the disclosure is primarily directed hereinafter to wall proximity reclining/tilt chair 10, it will be appreciated that the novel modular construction and method of assembly taught by the present invention can be readily incorporated into wall proximity sofas, loveseats and the like.

As best seen in FIG. 2, actuation mechanism 12 of wall proximity reclining/tilt chair 10 is integrated into and operably suspended from chair frame 20 and, in particular, from left and right side frame assemblies 24. In addition to side frame assemblies 24, chair 10 also includes a front rail assembly 26 and a rear rail 28 which, when interconnected, define a rigid "box-like" chair frame. Preferably, most of the structural frame components such as side frame assemblies 24, front rail assembly 26, and rear rail 28, are each constructed in a manner which enables them to support springs, padding, upholstery, etc. in order to complete a decorative and stylish reclining/tilt chair 10. As previously noted, each frame component is individually pre-assembled for subsequent modular assembly into wall proximity reclining/tilt chair 10. However, it is to be understood that the specific construction shown for each frame component is merely exemplary in nature.

Figure 3:
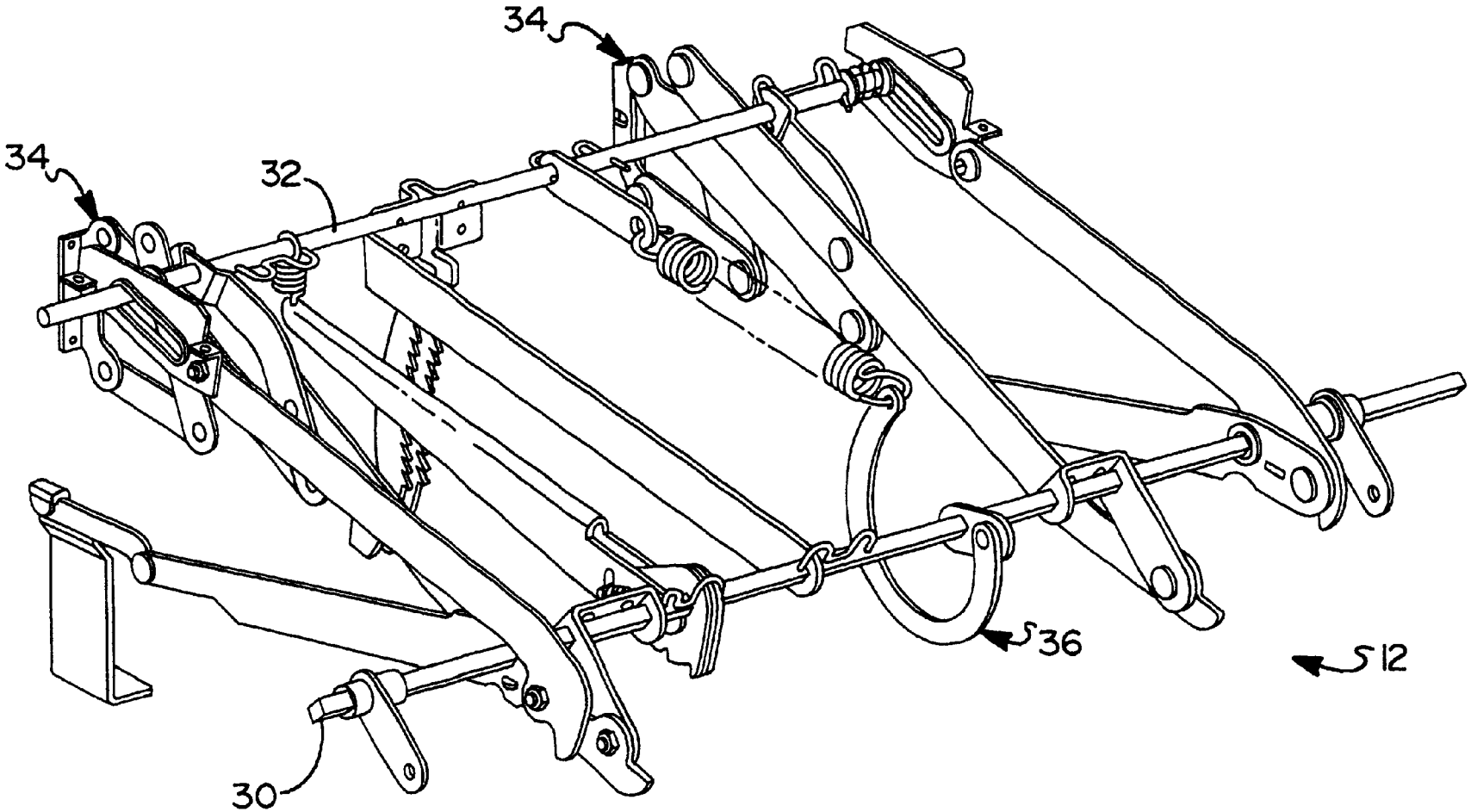
FIG. 3 is an enlarged prospective view of the actuation mechanism shown in FIG. 2.

With reference to FIGS. 2 and 3, actuation mechanism 12 is shown to include a drive rod 30 and front support shaft 32, both of which are spatially oriented to be precisely located and "suspended" from left and right side frame assemblies 24. In the preferred construction, drive rod 30 is an elongated square shaft having a manually-operable handle 38 (shown in FIG. 1) secured thereto adjacent an upholstered exterior portion of one of side frame assemblies 24 and which can be easily reached by a person seated in chair 10 for convenient actuation thereof. In addition, leg rest assembly 16 as shown in FIG. 1, is supported for extensible movement on actuation mechanism 12. More specifically, leg rest assembly 16 includes left and right pantograph linkages 34 and a spring-assisted toggle assembly 36 which are operably associated with drive rod 30 and front support shaft 32 for permitting the seat occupant to selectively actuate leg rest assembly 16 in response to rotation of drive rod 30 via the handle.

Leg rest assembly 16 is supported and moved by identical left and right hand pantograph linkages 34. Conventional pantograph linkages 34 are operably suspended about the second set of "fixed" suspension points defined by support shaft 32. The extensible action of leg rest assembly 16 takes place simultaneously for both the left hand and right hand pantograph linkages 34 when there is sufficient angular rotation of drive rod 30 via handle 38. With reference to FIG. 3, an exemplary construction for spring-assist toggle assembly 36 is shown which works coactively with leg rest pantograph linkages 34 for securely holding leg rest assembly 16 in a fully retracted position against front rail assembly 26. Toggle assembly 36 is also operable to supply a spring force for biasingly urging leg rest assembly 16 toward one of its extended and retracted positions. Further details concerning the pantograph linkages 34 and toggle assembly 36 can be found in U.S. Pat. No. 5,570,927, the disclosure of which has been expressly incorporated by references herein.

Figure 4:
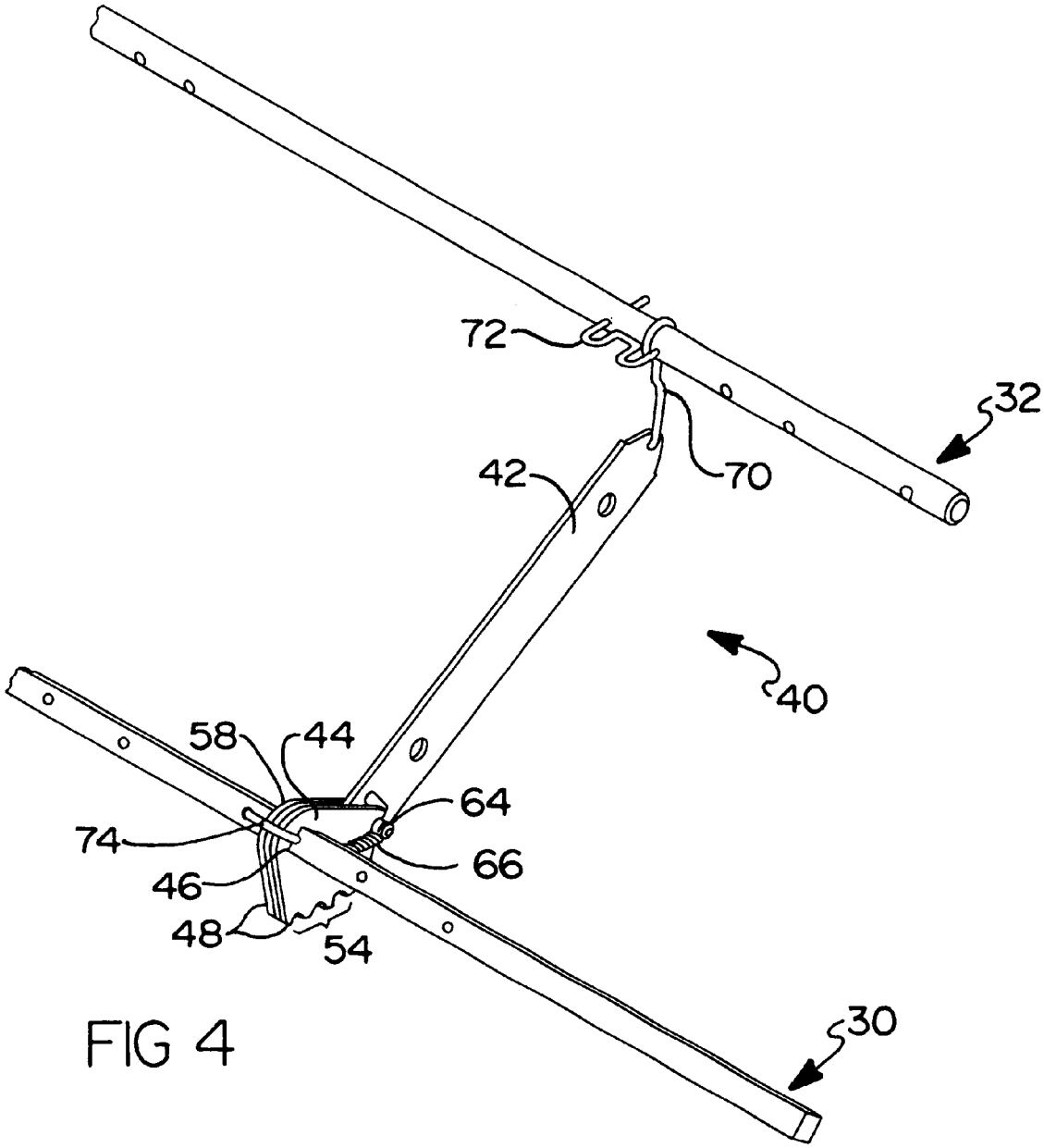
FIG. 4 is an enlarged prospective view of the improved three-position actuation mechanism shown in FIG. 3.
Figure 5:
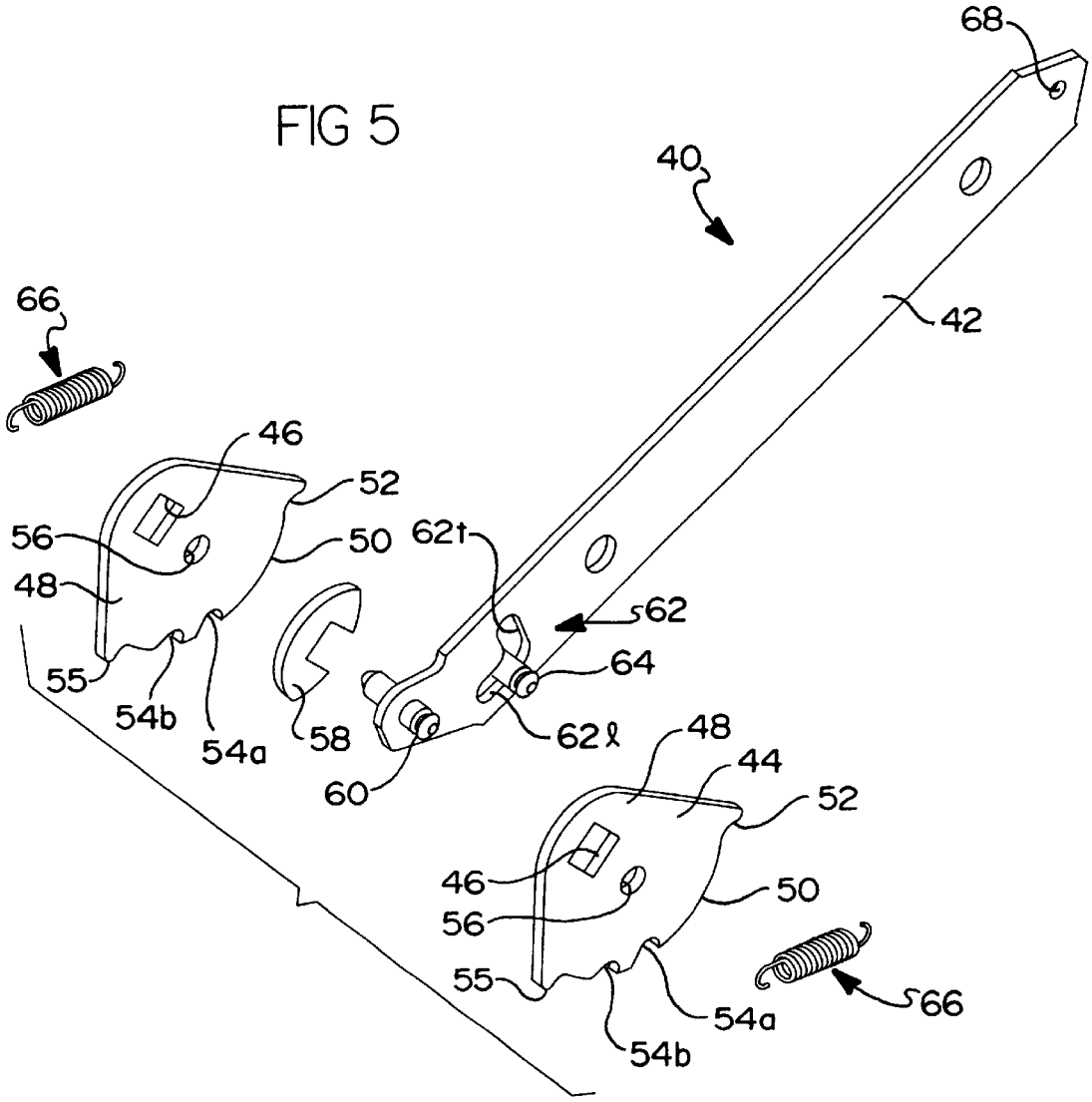
FIG. 5 is an exploded prospective view of the improved three-position actuation mechanism shown in FIG. 4.

According to the particular embodiment shown in FIGS. 4 and 5, a ratchet-type detent mechanism 40 interconnects drive rod 30 and support shaft 32 for providing various locked positions for leg rest assembly 16 between its "stowed" or retracted and "extended" positions. Generally, detent mechanism 40 provides three distinct locking positions for leg rest assembly 16 that can be established independent of the reclined/tilted position of chair 10.

Detent mechanism 40 includes a sector assembly 44 having a square aperture 46 formed therethrough to receive drive rod 30 so as to be supported for rotation thereon. An incline link 42 extends generally between drive rod 30 and front support shaft 32 in a manner as hereinafter described. Sector assembly 44 includes a pair of sector plates 48 having an arcuate peripheral edge 50 defining a first cam 52, a pair of locking recesses 54*a*, 54*b*, a second cam 55 and an aperture 56 formed therethrough. Sector assembly 44 further includes a spacer plate 58 interposed between the pair of sector plates 48. A pivot pin 60 extends through the rearward end of incline link 42 and is received in apertures 56 such that the sector plates 48 are pivotally supported on the incline link 42. A L-shaped guideway 62 having a longitudinal leg 62*l* at a transverse leg 62*t* is formed in incline link 42 forward of pivot pin 60 and receives a floating detent pin 64.

When assembled, as best seen in FIG. 4, the sector assembly 44 is supported for rotation therewith on the drive rod 30 and the incline link 42 is pivotally coupled to the sector assembly 44 through pivot pin 60. The floating detent pin 64 engages the arcuate peripheral edge 50 of the sector plates 48. A biasing mechanism or pair of tensioning springs 66 extend between pivot pin 60 and detent pin 64 to bias the detent pin 64 rearwardly towards the pivot pin 60.

The forward end of incline link 42 has an aperture 68 formed therethrough. A wire hanger element 70 extends from front support shaft 32 and has a free end which is received in aperture 68 of incline link 42. A position locking element 72 extends through the front support shaft 32 for locating and retaining the wire hanger element 70 on front support shaft 32. A similar retaining element 74 is utilized to locate and retain the sector assembly 44 on the drive rod 30.

In operation, actuation mechanism 12 and leg rest assembly 16 are in a retracted position and detent pin 64 is positioned into longitudinal leg 62*l* by first cam 52. When the drive rod 30 is rotated to extend the leg rest assembly 16, from the retracted position the sector assembly 44 is also rotated causing the detent pin 64 to traverse the peripheral edge 50 of the sector plates 48. When recess 54*a* is encountered, the tension spring 66 in combination with the longitudinal leg 62*l* permits the detent pin 64 to seat within the recess 54*a*. Counter-rotation of the drive rod 30 is resisted such that actuation mechanism 12 is positioned in a first intermediate position which is approximately one-third extended. Further rotation of the drive rod 30 overcomes the biasing force of the tension springs 66 causing the detent pin 64 to ratchet out of recess 54*a* and into recess 54*b*. Counter-rotation after drive rod 30 is again resisted such that leg rest assembly 16 is positioned in a second intermediate position which is approximately two-thirds extended. Further rotation of the drive rod 30 moves the detent pin 64 out of recess 54*b* until it engages second cam 55. In this position, the leg rest assembly 16 is fully extended and second cam 55 urge detent pin 64 forwardly and upwardly into transverse leg 62*t* of L-shaped guideway 62. In this manner, detent pin 64 is disengaged from the peripheral edge 50 of the sector plates 48 such that counter-rotation of the drive rod 30 is not inhibited by detent pin 64 acting on recesses 54*a,b* formed in the peripheral edge 50. Counter-rotation of drive rod 30 will return leg rest assembly 16 to its fully retracted position. As leg rest assembly 16 returns to its retracted position, sector assembly 44 rotates relative to incline link 42 and first cam 52 engages detent pin 64 to reset its position into longitudinal leg 62*l*. Tension springs 66 urge detent pin 64 rearwardly within guideway 62 into a bias with peripheral edge 50 of sector plates 48. In this manner, the detent mechanism 40 is reset.

From the above description, it will be appreciated that when the detent pin 64 is lockingly biased to one of the recesses 54, the leg rest assembly 16 is releaseably locked into a corresponding elevated position against inadvertent retraction by the detent mechanism 40. Furthermore, the leg rest assembly 16 can only be returned to its retracted position from an intermediate position by first fully protracting the leg rest assembly 16.

Detent mechanism 40 is designed to fail prior to any other members of actuation mechanism 12 due to misuse or overloading. Replacement of detent mechanism 40 requires partial disassembly of the chair and removal of drive rod 30. Thus, an alternate embodiment of detent mechanism 40 is illustrated in FIGS. 6, 7 and 8 which is adapted for use with actuation mechanism 12 and which facilitates replacement of detent mechanism 40 without disassembly of the chair or removal of drive rod 30.

Figure 6:
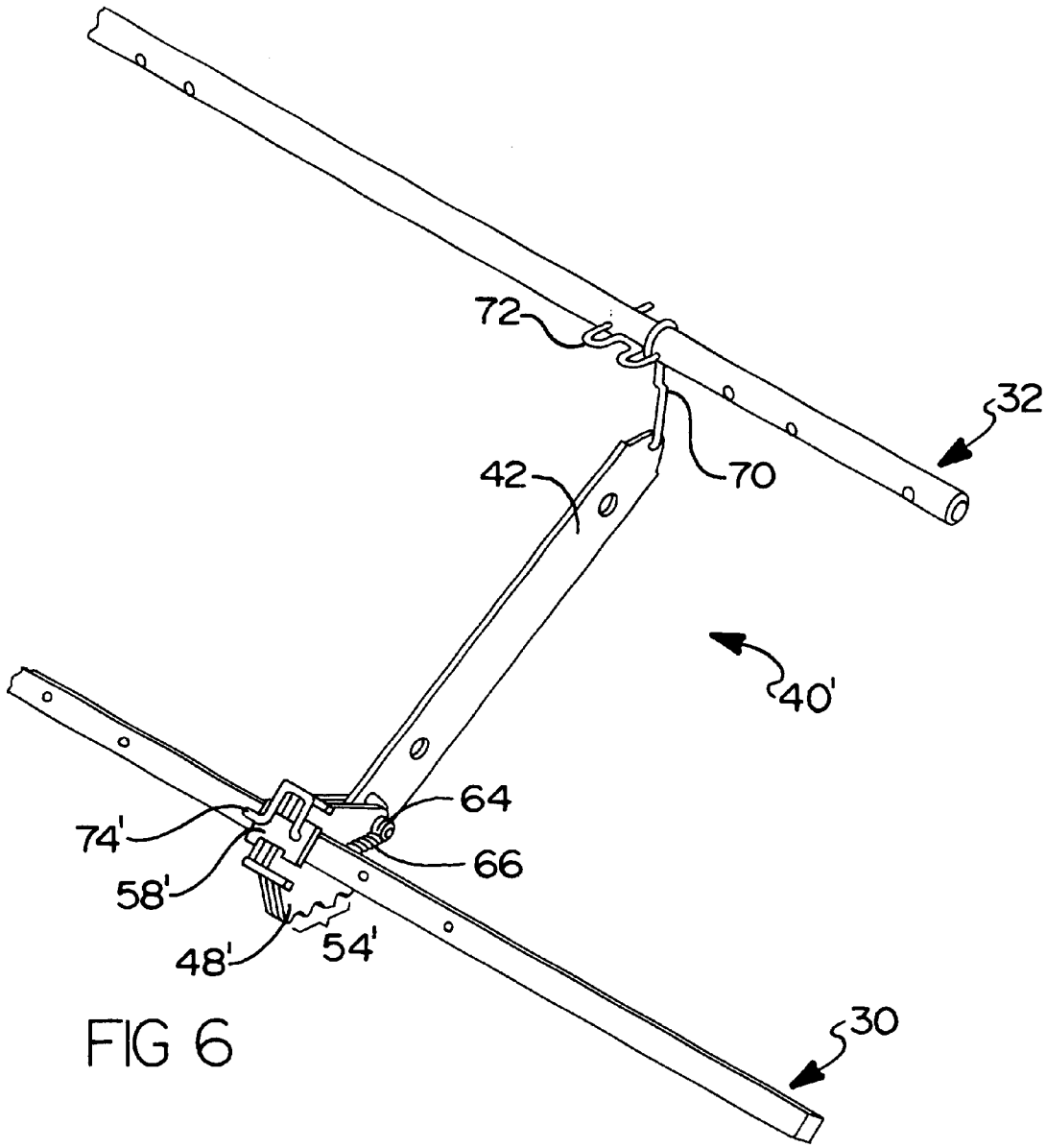
FIG. 6 is an enlarged prospective view of an alternate embodiment of this improved three-position actuation mechanism shown in FIG. 3.
Figure 7:
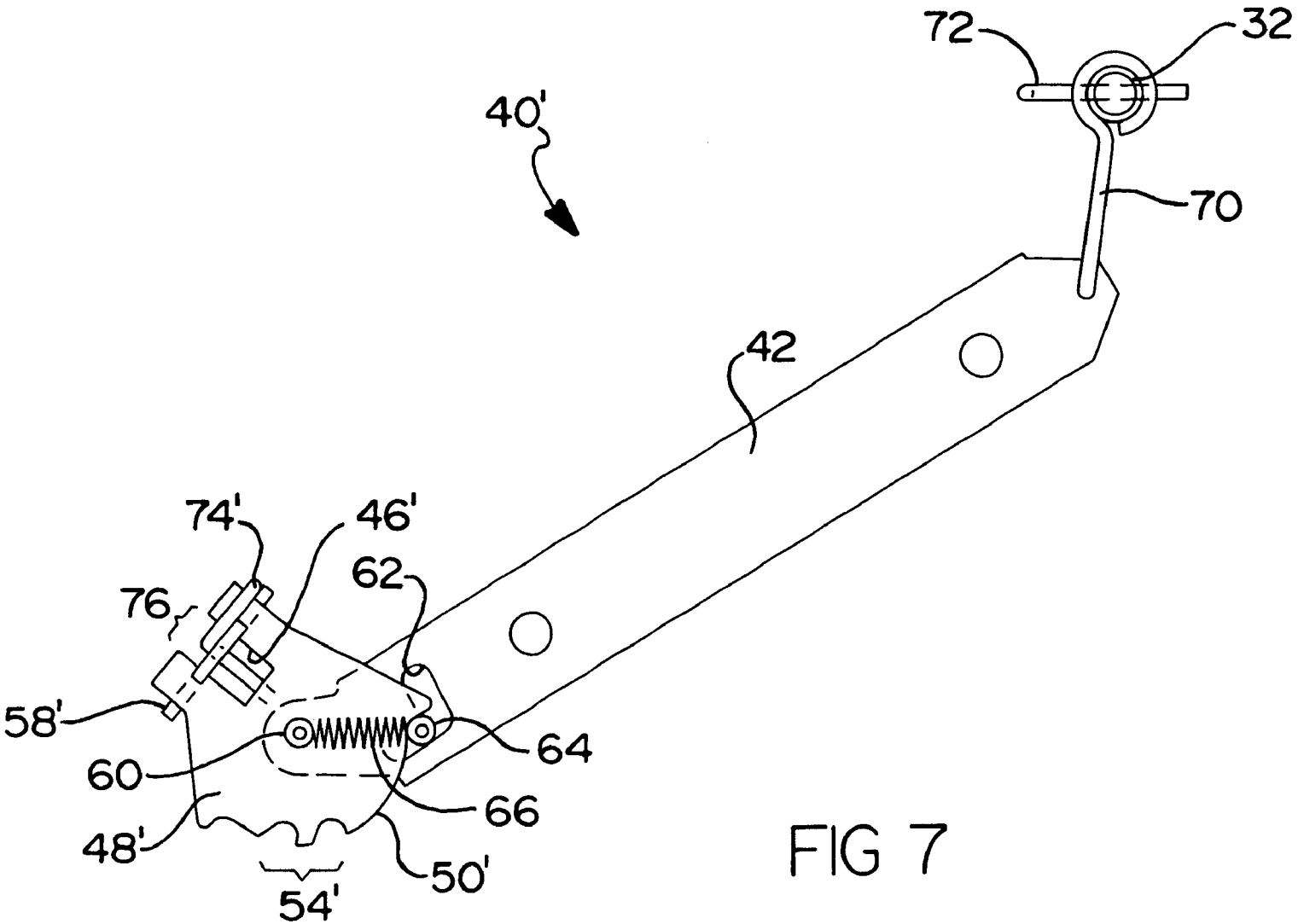
FIG. 7 is an enlarged view of the alternate embodiment of FIG. 6.
Figure 8:
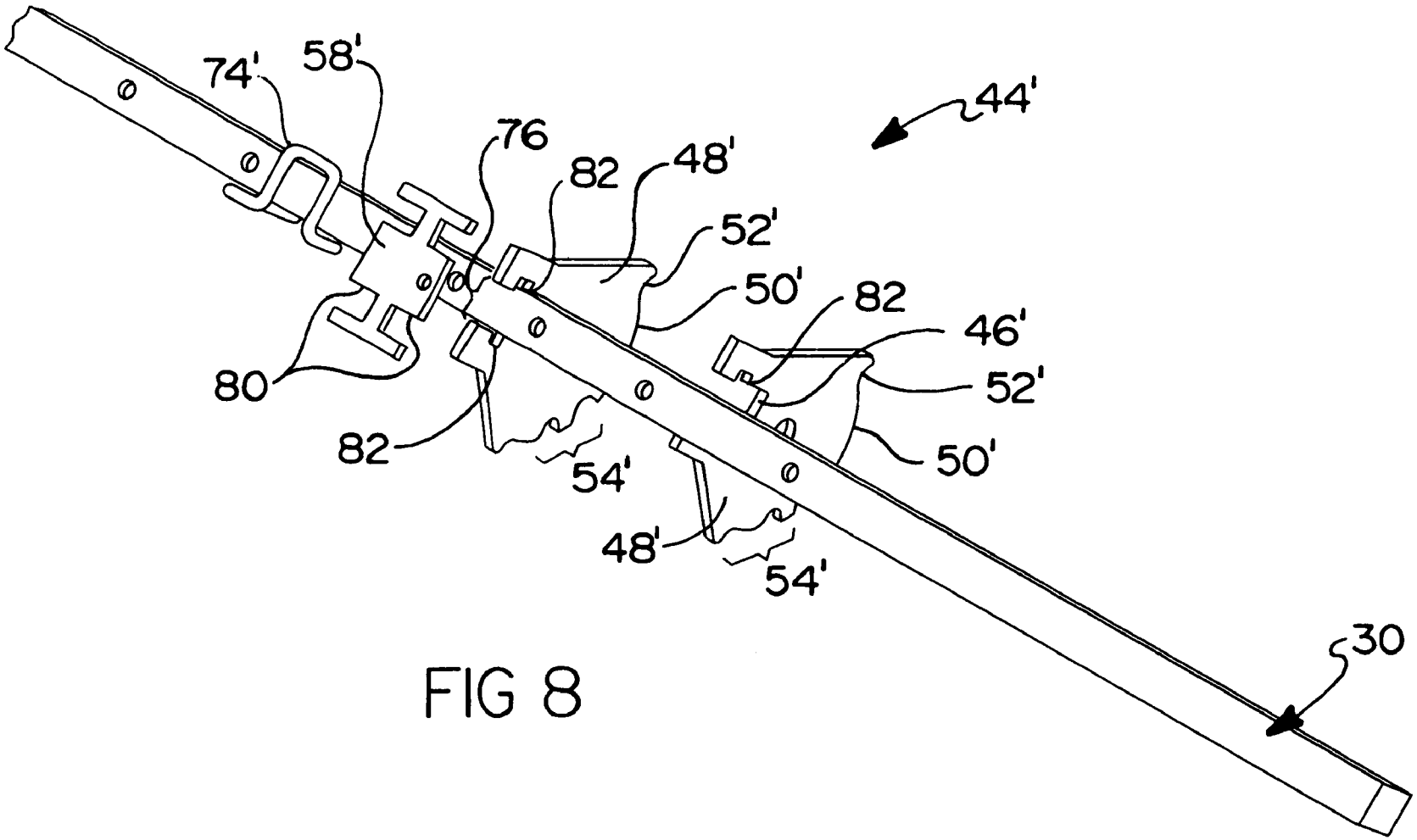
FIG. 8 is an enlarged prospective view of the ratchet sector plate shown in FIG. 7.

Referring now to FIGS. 6, 7 and 8, detent mechanism 40' is substantially similar to detent mechanism 40 with modifications relating to the attachment of sector plates 48' to drive rod 30. More specifically, square aperture 46' of sector plates 48' extends away from the peripheral edge 50' that engages detent pin 64 to form a cut out 76 in sector plates 48'. Spacer plate 58 is replaced with a spacer plate 58' to maintain the proper spacing between sector plates 48' and to couple the drive rod 30 to the sector assembly 44'. Spacer plate 58' includes locking edges 80 that slidably engage retainer notches 82 of sector plates 48' and retain sector plates 48' on drive rod 30. Retaining element 74' is used to locate sector assembly 44' on drive rod 30. Operation of alternate embodiment detent mechanism 40' is substantially similar to operation of detent mechanism 40.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. In an actuation mechanism of the type having a drive rod and a front support shaft, a leg rest assembly for releasable positioning a leg rest in a retracted position, an extended position and at least one intermediate position, said leg rest positioning mechanism comprising:

an incline link having a pivot pin extending therethrough at a first end, an L-shaped guideway formed though said incline link adjacent said pivot pin, a second end of said incline link being coupled to the front support shaft;

a sector assembly including a sector plate disposed on each side of said incline link and rotatably supported on said pivot pin and a spacer plate interposed between each of said sector plates, each of said sector plates being coupled to the drive rod for co-rotation therewith and having a peripheral edge with a first cam, a second cam and at least one recess formed therein;

a detent pin received in said L-shaped guideway and engaging said peripheral edge of said sector plates;

a biasing mechanism for biasing said detent pin into engagement with said peripheral edge;

wherein said first cam positions said detent pin into a longitudinal portion of said L-shaped guideway when the leg rest is in a retracted position, said detent pin engages said at least one recess when the leg rest is in an intermediate position and said second cam positions said detent pin into a transverse portion of said L-shaped guideway when the leg rest is in an extended position.

2. The leg rest positioning mechanism of claim 1 wherein said biasing mechanism comprises a spring disposed on each side of said incline link, each of said springs extending between said pivot pin and said detent pin.

3. The leg rest positioning mechanism of claim 1 wherein said peripheral edge has a first recess and a second recess formed therein, said detent pin engaging said first recess when said leg rest assembly is approximately one-third extended and said detent pin engaging said second recess when said leg rest assembly is approximately two-thirds extended.

4. The leg rest positioning mechanism of claim 1 wherein each of said sector plates has a square aperture formed therethrough receiving said drive rod having a square cross-section.

5. The leg rest positioning mechanism of claim 1 wherein said sector assembly further comprises a retaining element for positioning and securing each of said sector plates and said spacer plate to said drive rod.

6. The leg rest positioning mechanism of claim 1 wherein each of said sector plates has a slot formed therein receiving said drive rod having a square cross-section, and a spacer plate securing each of said sector plates to said drive rod for co-rotation therewith.

7. The leg rest positioning mechanism of claim 6 wherein said sector assembly further comprises a retaining element for positioning and securing each of said sector plates and said spacer plate to said drive rod.

8. The leg rest positioning mechanism of claim 1 further comprising a hanger extending from said second end of said incline link, said hanger coupling said incline link to said front support shaft.

9. An actuation mechanism for a chair having a retractable leg rest assembly comprising:

a drive rod and a front support shaft;

a pantograph linkage operably coupled to said drive rod and a leg rest panel secured to an end of said pantograph linkage for coordinated articulated movement between a retracted position, an intermediate position and an extended position in response to rotation of said drive rod;

a leg rest positioning mechanism having:

an incline link with a pivot pin extending therethrough at a first end, an L-shaped guideway formed though said incline link adjacent said pivot pin, a second end of said incline link being coupled to said front support shaft;

a sector assembly including a sector plate disposed on each side of said incline link and rotatably supported on said pivot pin and a spacer plate interposed between each of said sector plates, each of said sector plates being coupled to the drive rod for co-rotation therewith and having a peripheral edge with a first cam, a second cam and at least one recess formed therein;

a detent pin received in said L-shaped guideway and engaging said peripheral edge of said sector plates;

a biasing mechanism for biasing said detent pin into engagement with said peripheral edge;

wherein said first cam positions said detent pin into a longitudinal portion of said L-shaped guideway when the leg rest panel is in said retracted position, said detent pin engages said at least one recess when the leg rest panel is in said intermediate position and said second cam positions said detent pin into a transverse portion of said L-shaped guideway when the leg rest is in said extended position.

10. The actuation mechanism of claim 9 wherein said biasing mechanism comprises a spring disposed on each side of said incline link, each of said springs extending between said pivot pin and said detent pin.

11. The actuation mechanism of claim 9 wherein said peripheral edge has a first recess and a second recess formed therein, said detent pin engaging said first recess when said leg rest panel is approximately one-third extended and said detent pin engaging said second recess when said leg rest panel is approximately two-thirds extended.

12. The actuation mechanism of claim 9 wherein each of said sector plates has a square aperture formed therethrough receiving said drive rod having a square cross-section.

13. The actuation mechanism of claim 9 wherein said sector assembly further comprises a retaining element for positioning and securing each of said sector plates and said spacer plate to said drive rod.

14. The actuation mechanism of claim 9 wherein each of said sector plates has a slot formed therein receiving said drive rod having a square cross-section, and a spacer plate securing each of said sector plates to said drive rod for co-rotation therewith.

15. The actuation mechanism of claim 14 wherein said sector assembly further comprises a retaining element for positioning and securing each of said sector plates and said spacer plate to said drive rod.

16. The actuation mechanism of claim 9 further comprising a hanger extending from said second end of said incline link and coupling said incline link to said front support shaft.

17. The actuation mechanism of claim 9 further comprising a toggle assembly operably coupled between said drive rod and said front support shaft for maintaining said leg rest panel in said extended position.

18. The actuation mechanism of claim 17 wherein said toggle assembly is operably coupled between said drive rod and said front support shaft to generate a biasing force to urge said pantograph linkage towards said retracted position and said extended position.

* * * * *

UNITED STATES PATENT AND TRADEMARK OFFICE

CERTIFICATE OF CORRECTION

PATENT NO. : 6,655,732 B1
DATED : December 2, 2003
INVENTOR(S) : Larry P. LaPointe It is certified that error appears in the above-identified patent and that said Letters Patent is hereby corrected as shown below:

Column 1,
Line 34, after “mechanism:” insert -- . --.
Line 50, “propective” should be -- perspective --.
Line 52, 54, 56 and 61, “propsective” should be -- perspective --.

Column 3,
Line 48, “refereces” should be -- reference --.

Column 5,
Line 38, “though” should be -- through --.

Column 6,
Line 37, “though” should be -- through --.

Signed and Sealed this

Thirtieth Day of March, 2004

JON W. DUDAS
*Acting Director of the United States Patent and Trademark Office*